US009714111B2

(12) United States Patent
Itano

(10) Patent No.: US 9,714,111 B2
(45) Date of Patent: Jul. 25, 2017

(54) CUSHIONING MATERIAL AND PACKAGE USING SAME

(71) Applicant: KYOCERA Document Solutions Inc., Osaka (JP)

(72) Inventor: Atsushi Itano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 137 days.

(21) Appl. No.: 14/782,186

(22) PCT Filed: Oct. 6, 2014

(86) PCT No.: PCT/JP2014/076655
§ 371 (c)(1),
(2) Date: Oct. 2, 2015

(87) PCT Pub. No.: WO2015/060111
PCT Pub. Date: Apr. 30, 2015

(65) Prior Publication Data

US 2016/0016686 A1 Jan. 21, 2016

(30) Foreign Application Priority Data

Oct. 25, 2013 (JP) ..... 2013-222095

(51) Int. Cl.
*B65D 81/02* (2006.01)
*B65D 85/30* (2006.01)
(Continued)

(52) U.S. Cl.
CPC ..... *B65D 5/505* (2013.01); *B65D 5/5069* (2013.01); *B65D 81/051* (2013.01); *B65D 81/058* (2013.01)

(58) Field of Classification Search
CPC .... B65D 5/505; B65D 5/5069; B65D 81/051; B65D 81/058; B65D 5/5052;
(Continued)

(56) References Cited

U.S. PATENT DOCUMENTS 5,979,659 A * 11/1999 Kataoka ..... B65D 5/5071 206/320
6,268,039 B1 * 7/2001 Chou ..... B65D 5/5035 206/453
(Continued)

FOREIGN PATENT DOCUMENTS

JP 2007-22566 A 2/2007

OTHER PUBLICATIONS

International Search Report dated Dec. 22, 2015, issued to International Application No. PCT/JP2014/076655.

*Primary Examiner* — J. Gregory Pickett
*Assistant Examiner* — Rafael Ortiz
(74) *Attorney, Agent, or Firm* — Stein IP, LLC

(57) ABSTRACT

The cushioning material is assembled by: bending a single sheet, which comprises a bottom sheet, a first side sheet, a second side sheet, and an upper sheet, into a rectangular cylinder shape and inserting second flaps and an interlocking sheet in an insertion hole of a middle sheet; bending each first flap away from the first side sheet and bending the middle sheet towards the first side sheet to fit together second interlocking grooves with first interlocking grooves; bending the interlocking sheet to be roughly perpendicular to the upper sheet and bending the second flaps to be roughly perpendicular to the interlocking sheet to engage interlocking sections with the first flaps.

8 Claims, 5 Drawing Sheets

(51) Int. Cl.
*B65D 5/50* (2006.01)
*B65D 81/05* (2006.01)

(58) Field of Classification Search
CPC ..... B65D 5/5078; B65D 2301/10; B65D 81/3858; B65D 5/445; B65D 5/5213; B65D 5/724
USPC ..... 206/594, 591, 592, 593, 587, 701, 722, 206/723; 229/87.02, 933–937, 103.11, 229/199
See application file for complete search history.

(56) References Cited

U.S. PATENT DOCUMENTS

2003/0205498 A1* 11/2003 Maresh ..... B65D 5/5069 206/592
2004/0084349 A1* 5/2004 Kari ..... B65D 5/5069 206/583

* cited by examiner

CUSHIONING MATERIAL AND PACKAGE USING SAME

CROSS-REFERENCE TO RELATED APPLICATIONS

This application is a national stage of International Application No. PCT/JP2014/076655, filed Oct. 6, 2014, which claims the benefit of Japanese Application No. 2013-222095, filed Oct. 25, 2013, in the Japanese Patent Office, the disclosures of which are incorporated herein by reference.

TECHNICAL FIELD

The present invention relates to a cushioning material constructed by folding a single sheet, and to a package using such a cushioning material.

BACKGROUND ART

Conventionally, when an electronic appliance or the like is packed, it is common to place, in a cardboard case, a cushioning material for absorbing impact and vibration from outside during transport and place a product (article to be packed) on the cushioning material such that the to-be-cushioned surface of the product rests on the product placement surface of the cushioning material. As one type of such cushioning materials, there are known those which are constructed by folding a single cardboard sheet into a predetermined shape.

For example, Patent Document 1 identified below discloses, as a cushioning material that is constructed by folding a single cardboard sheet, a cardboard cushioning material in which cuts are formed in part of a cardboard sheet according to the exterior shape of an article to be packed so that, when the sheet is folded such that the cuts fit the exterior shape of the article, an article insertion space is left into which at least part of the article can be inserted. Here, with a remaining part of the cardboard sheet, a hollow cushioning portion is formed so as to adjoin the surface of a cardboard stack opposite the article insertion surface.

LIST OF CITATIONS

Patent Literature

Patent Document 1: Japanese Patent Application Publication No. 2007-22566

SUMMARY OF THE INVENTION

Technical Problem

Inconveniently, however, the cushioning material disclosed in Patent Document 1 is configured such that the entire exterior of the packed article is covered by the cardboard sheet. This requires a large amount of cardboard sheet, and requires an increasingly large amount of cardboard sheet as the number of faces, or the area of the surface, on which to rest the article increases.

Against the background discussed above, an object of the present invention is to provide a cushioning material that can be constructed by folding a single sheet and that can absorb external forces from five directions with no increase in the amount of sheet used.

Means for Solving the Problem

To achieve the above object, a first configuration of the present invention is a cushioning material that is constructed from a single sheet material. The cushioning material has a rectangular bottom segment, a first and a second side segment, a top segment, an engagement segment, a pair of first flaps, a penetrated hole, a pair of second flaps, a pair of first engagement grooves, and a pair of second engagement grooves. The first and second side segments are arranged at two opposite sides of the bottom segment, so as to be contiguous with the bottom segment across folding lines respectively. The top segment is arranged at the side of the first side segment opposite from the bottom segment, so as to be contiguous with the first side segment across a folding line. The middle segment is arranged at the side of the second side segment opposite from the bottom segment, so as to be contiguous with the second side segment across a folding line. The engagement segment is arranged at the side of the top segment opposite from the first side segment, so as to be contiguous with the top segment opposite across a folding line. The first flaps are arranged at two sides of the middle segment perpendicular to its side at which the second side segment is contiguously arranged, so as to be contiguous with the middle segment across folding lines respectively. The penetrated hole is formed to extend from the middle segment beyond folding lines into parts of the first flaps respectively, so as to be penetrated by the engagement segment. The second flaps are arranged at two sides of the engagement segment perpendicular to its side at which the top segment is contiguously arranged, so as to be contiguous with the engagement segment across folding lines respectively. The second flaps have engagement portions formed at their respective tip ends. The first engagement grooves are formed at the gaps between the first side segment and the top segment by extending the first side segment such that the first side segment embraces the top segment from opposite sides. The second engagement grooves are formed by extending the penetrated hole at its opposite ends. The bottom segment, the first side segment, the second side segment, and the top segment are folded into a rectangular column such that the second flaps and the engagement segment are inserted into the penetrated hole. The first flaps are folded away from the first side segment and the middle segment is folded toward the first side segment such that the second engagement grooves are fitted in the first engagement grooves. The engagement segment is folded to be substantially perpendicular to the top segment and the second flaps are folded to be substantially perpendicular to the engagement segment such that the engagement portions are engaged with the first flaps. Now, the middle segment and the top segment are held substantially parallel to the bottom segment.

Advantageous Effects of the Invention

With the first configuration according to the present invention, a cushioning material is constructed integrally from a single sheet material. This helps reduce the number of components of a cushioning material and facilitate its construction. It is also possible to reduce the space for storage of cushioning materials before being constructed. Moreover, since external forces from five directions can be absorbed reliably, it is possible to reduce the number of cushioning materials needed and the amount of sheet material used to form the cushioning material, and to effectively prevent jolting and rattling of the packed article during transport.

DESCRIPTION OF EMBODIMENTS

Figure 1:
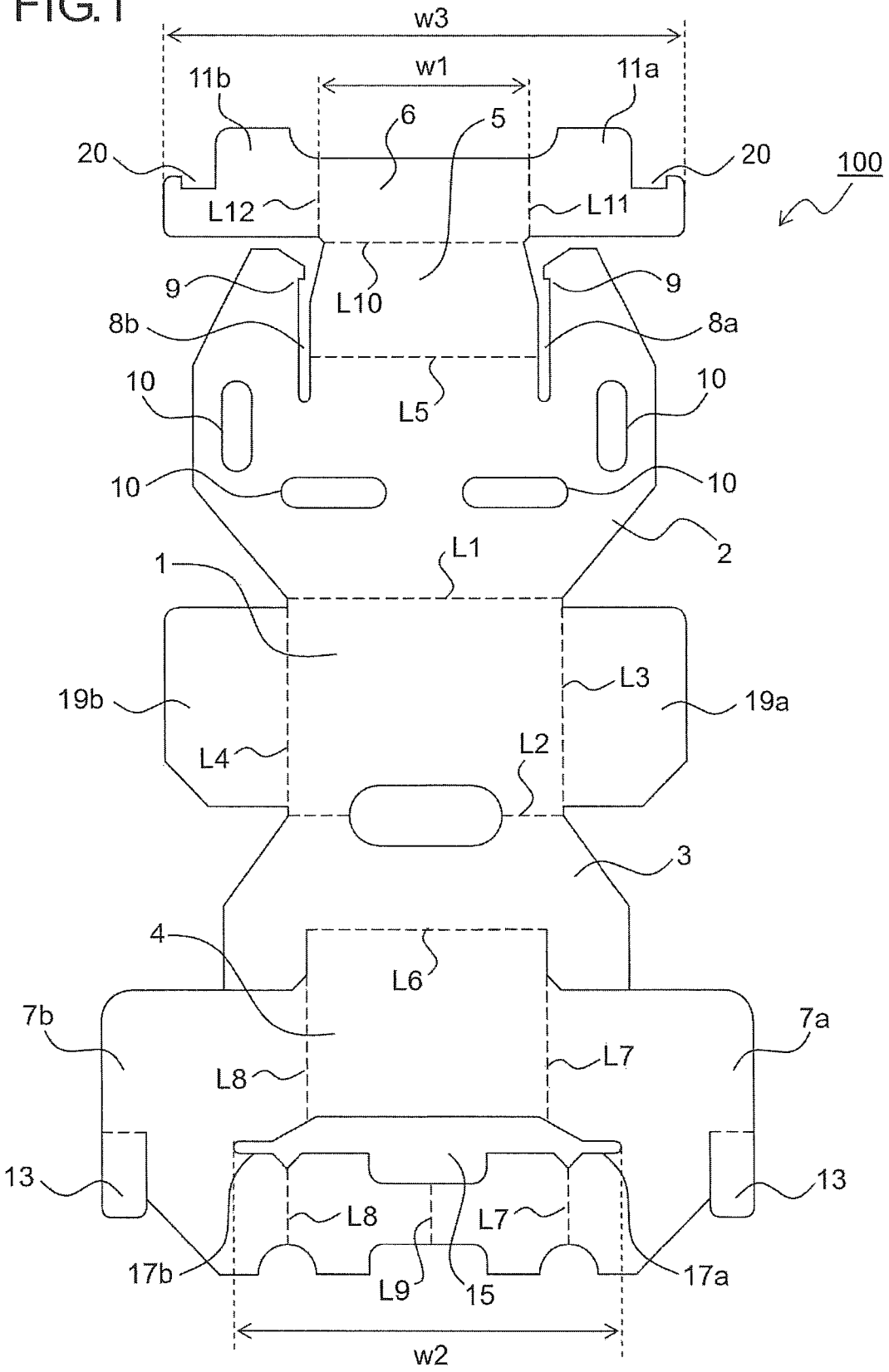
FIG. 1 is a developed view of a cushioning material 100 according to the present invention.

Hereinafter, an embodiment of the present invention will be described with reference to the accompanying drawings. FIG. 1 is a developed view of a cushioning material 100 according to the present invention. In FIG. 1, cuts are indicated by solid lines, and folding lines (creases) are indicated by broken lines. The cushioning material 100 is formed by being constructed from a single sheet material punched out into a predetermined shape as shown in FIG. 1. The cushioning material 100 is roughly composed of a bottom segment 1, a first side segment 2, a second side segment 3, a middle segment 4, a top segment 5, and an engagement segment 6, all these segments being contiguous with each other across folding lines.

At two opposite sides of the bottom segment 1, the first and second side segments 2 and 3 are arranged contiguously across folding lines L1 and L2 respectively. At the other two sides of the bottom segment 1, third flaps 19*a* and 19*b* are arranged contiguously across folding lines L3 and L4 respectively.

At the side of the first side segment 2 opposite from the bottom segment 1, the top segment 5 is arranged contiguously across a folding line L5. The first side segment 2 is extended so as to embrace the top segment 5 from opposite sides, and the gaps between the first side segment 2 and the top segment 5 form first engagement grooves 8*a* and 8*b*. Near the open ends of the first engagement grooves 8*a* and 8*b* respectively, engagement claws 9 are formed that protrude inward from the first side segment 2, and in the first side segment 2, oblong cut holes 10 are formed at four places.

At the side of the second side segment 3 opposite from the bottom segment 1, the middle segment 4 is arranged contiguously across a folding line L6. At the two sides of the middle segment 4 adjoining the folding line L6, first flaps 7*a* and 7*b* are arranged contiguously across folding lines L7 and L8. At side edges of the first flaps 7*a* and 7*b* respectively, engagement tabs 13 are formed. A penetrated hole 15 is formed so as to extend from the middle segment 4 across the folding lines L7 and L8 into the first flaps 7*a* and 7*b*, and at opposite ends of the penetrated hole 15, second engagement grooves 17*a* and 17*b* are formed.

Here, in a base-end part of the middle segment 4 relative to the penetrated hole 15 (in FIG. 1, the part upward of the penetrated hole 15), the interval between the folding lines L7 and L8 is substantially equal to the interval between the first engagement grooves 8*a* and 8*b*. On the other hand, in a tip-end part of the middle segment 4 relative to the penetrated hole 15 (in FIG. 1, the part downward of the penetrated hole 15), the interval between the folding lines L7 and L8 is wider than the interval between the first engagement grooves 8*a* and 8*b*. In this tip-end part of the middle segment 4 relative to the penetrated hole 15, a folding line L9 is formed between the folding lines L7 and L8.

At the side of the top segment 5 opposite from the first side segment 2, the engagement segment 6 is arranged contiguously across a folding line L10. At the two sides of the engagement segment 6 adjoining the folding line L10, second flaps 11*a* and 11*b* are arranged contiguously across folding lines L11 and L12 respectively. At tip ends of the second flaps 11*a* and 11*b* respectively, engagement portions 20 are formed.

Here, the width-direction dimension w1 of the engagement segment 6, the opening width w2 of the penetrated hole 15 plus the second engagement grooves 17*a* and 17*b* in their length direction, and the width-direction dimension w3 of the engagement segment 6 plus the second flaps 11*a* and 11*b* fulfill the relationship w1<w2<w3.

Figure 2:
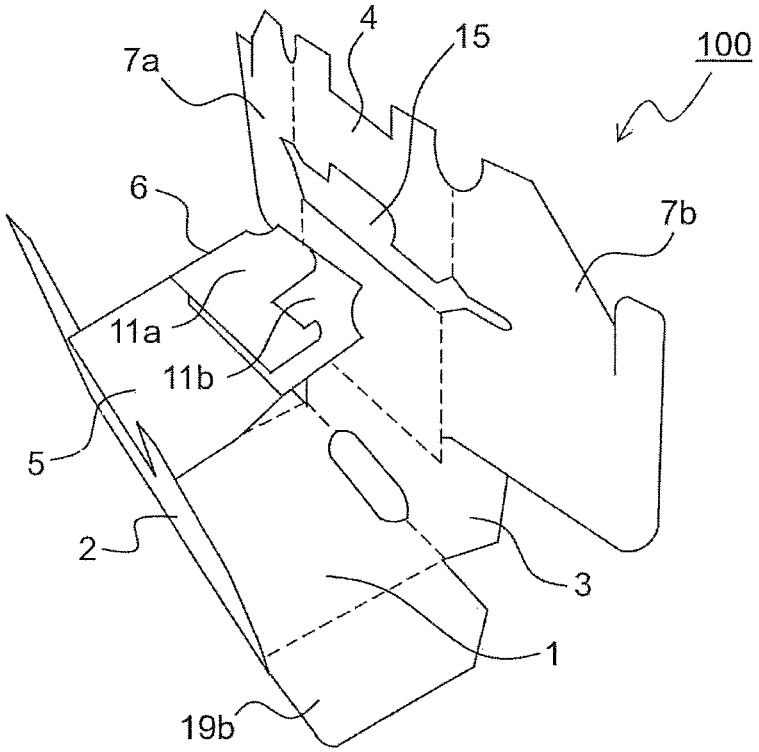
FIG. 2 is a perspective view showing a procedure of constructing the cushioning material 100, at a stage where the bottom segment 1, the first side segment 2, the second side segment 3, and the top segment 5 are folded into a rectangular column and the engagement segment 6 having the second flaps 11*a* and 11*b* folded to overlap it is inserted into the penetrated hole 15 in the middle segment 4.

Next, with reference to FIGS. 1 to 6, a procedure of constructing the cushioning material 100 according to the present invention will be described. First, as shown in FIG. 2, starting with the state shown in FIG. 1, the bottom segment 1, the first side segment 2, the second side segment 3, and the top segment 5 are folded along the folding lines L1, L2, and L5 into a rectangular column. Next, the second flaps 11*a* and 11 *b* on the engagement segment 6 arranged contiguously with the top segment 5 are folded along the folding lines L11 and 12 so as to overlap the engagement segment 6.

Figure 3:
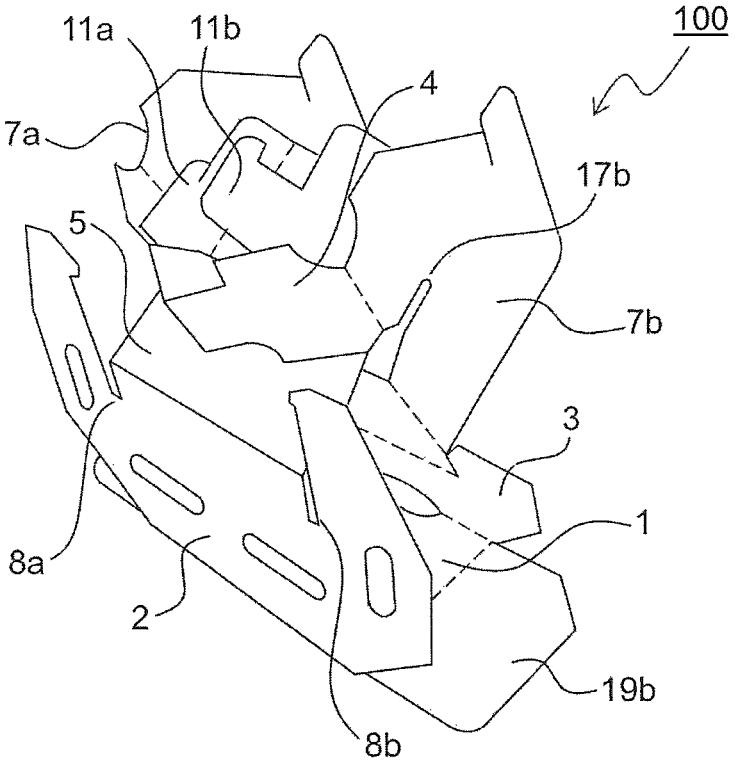
FIG. 3 is a perspective view showing a procedure of constructing the cushioning material 100, at a stage where, as compared with the stage shown in FIG. 2, the first flaps 7*a* and 7*b* are folded away from the first side segment 2.

Then, as shown in FIG. 3, the engagement segment 6 having the second flaps 11*a* and 11*b* folded to overlap it is inserted into the penetrated hole 15 in the middle segment 4. Moreover, the first flaps 7*a* and 7*b* arranged contiguously at opposite sides of the middle segment 4 are folded along folding lines L7 and L8 away from the first side segment 2.

Figure 4:
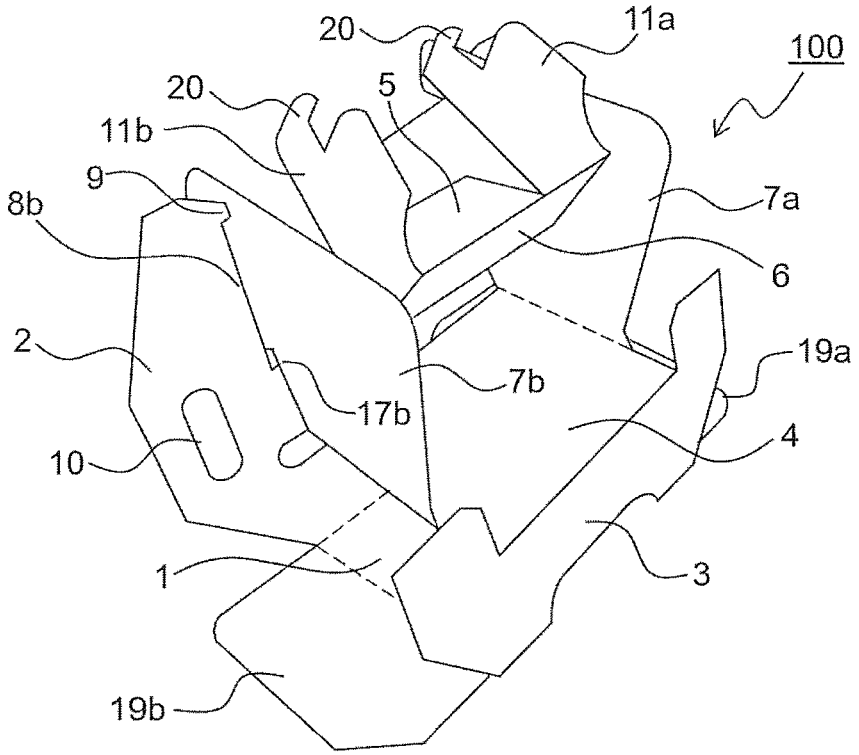
FIG. 4 is a perspective view showing a procedure of constructing the cushioning material 100, at a stage where, as compared with the stage shown in FIG. 3, the middle segment 4 is folded toward the first side segment 2 so that the second engagement grooves 17*a* and 17*b* are fitted into the first engagement grooves 8*a* and 8*b*, the engagement segment 6 is folded to be substantially perpendicular to the top segment 5, and the second flaps 11*a* and 11*b* are folded to be substantially perpendicular to the engagement segment 6.

Next, as shown in FIG. 4, the middle segment 4 is folded along the folding line L6 so as to lean toward the first side segment 2, and the second engagement grooves 17*a* and 17*b* in the first flaps 7*a* and 7*b* are fitted into the first engagement grooves 8*a* and 8*b* in the first side segment 2. Then, the engagement segment 6 is folded along the folding line L10 so as to be substantially perpendicularly upright relative to the top segment 5, and the second flaps 11*a* and 11*b* arranged contiguously at opposite sides of the engagement segment 6 are folded so as to be substantially perpendicularly upright relative to the engagement segment 6.

Figure 5:
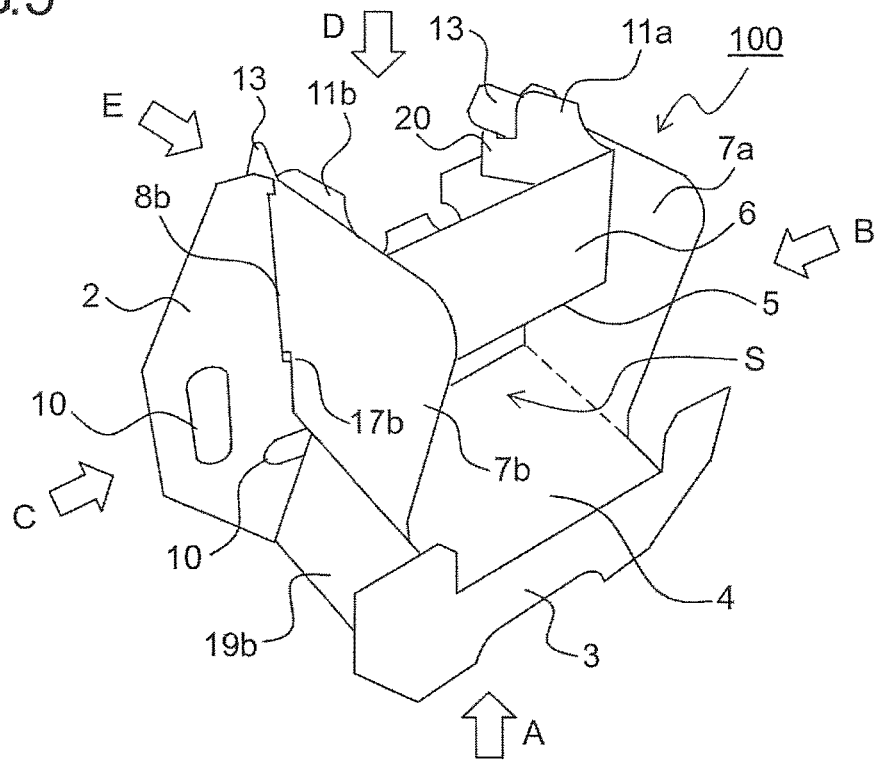
FIG. 5 is a perspective view showing a procedure of constructing the cushioning material 100, at a stage where, as compared with the stage shown in FIG. 4, the engagement portions 20 are engaged with the engagement claws 9 to complete construction.

Next, as shown in FIG. 5, the second engagement grooves 17*a* and 17*b* and the first engagement grooves 8*a* and 8*b* are engaged together completely. Then, the engagement tabs 13 formed at side edges of the first flaps 7*a* and 7*b* are folded inward so as to be engaged with the engagement portions 20 formed at the tip ends of the second flaps 11*a* and 11*b*, so that the middle segment 4 and the top segment 5 are held substantially parallel to the bottom segment 1. Lastly, the third flaps 19*a* and 19*b* are folded along the folding lines L3 and L4 so as to be put under the middle segment 4. In this way, the cushioning material 100 is constructed.

Figure 6:
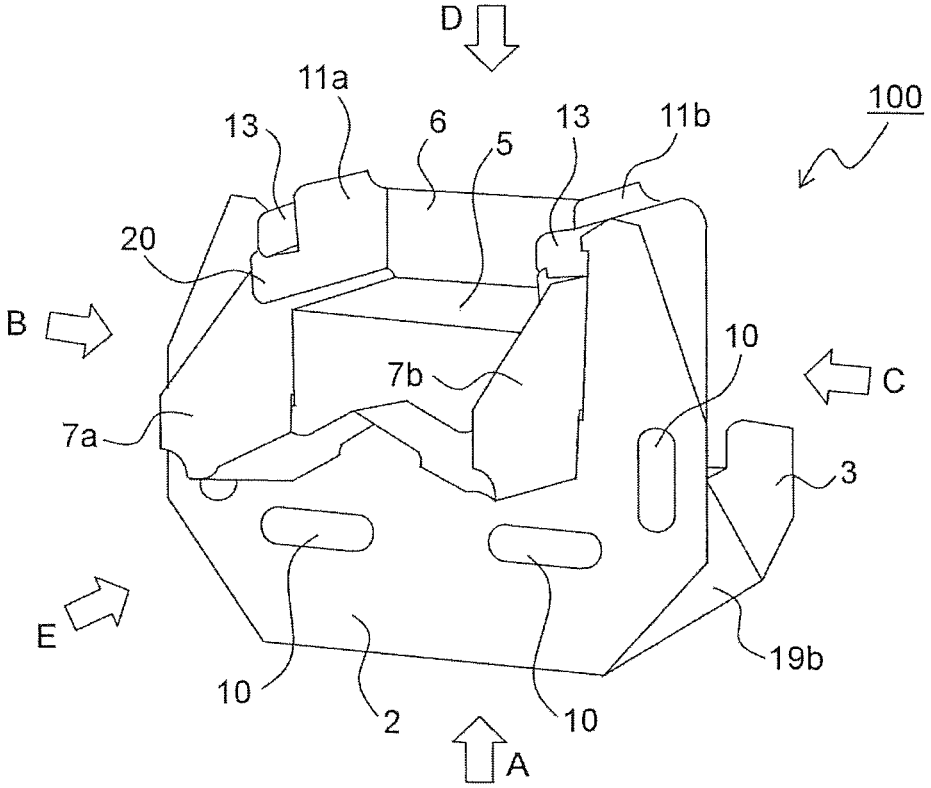
FIG. 6 is a perspective view of the cushioning material 100 shown in FIG. 5 as seen from the first side segment 2 side.

As described previously, in a tip-end part of the middle segment 4 relative to the penetrated hole 15, the interval between the folding lines L7 and L8 is wider than the interval between the first engagement grooves 8*a* and 8*b*. Accordingly, as shown in FIG. 6, when the constructed cushioning material 100 is seen from the first side segment 2 side, the tip-end part of the middle segment 4 relative to the penetrated hole 15 (the part protruding outward from the first side segment 2) is folded substantially into a V shape along the folding line L9. Thus, owing to the resilient force of the folded sheet, the first flaps 7*a* and 7*b* are acted on by a force that tends to unfold them, and this makes it difficult for the first engagement grooves 8*a* and 8*b* and the second engagement grooves 17*a* and 17*b* to disengage from each other.

Figure 7:
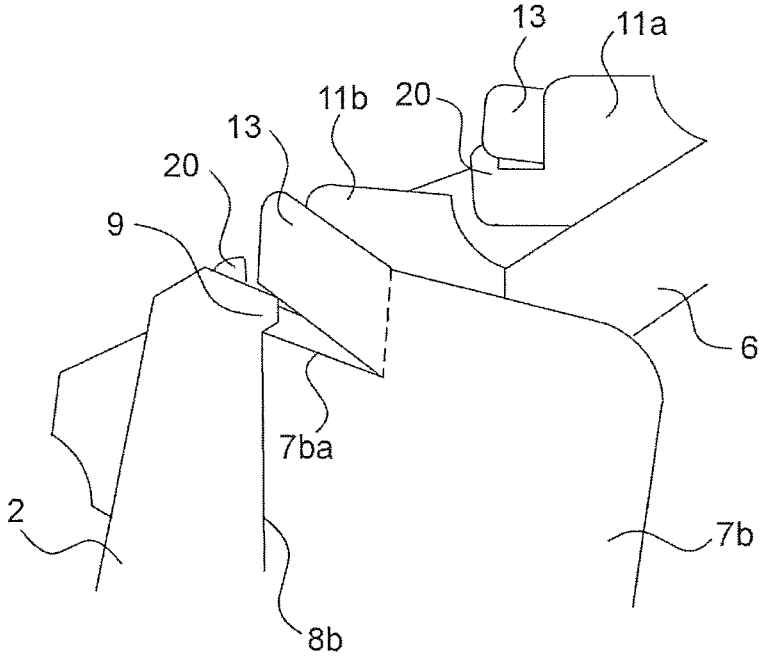
FIG. 7 is an enlarged perspective view showing an engagement claw 9 engaged with a side edge 7*ba* of the first flap 7*b;*

Moreover, owing to the resilient force of the middle segment 4 folded toward the first side segment 2, even if the first flaps 7*a* and 7*b* swing upward (in such a direction as to disengage the first engagement grooves 8*a* and 8*b* and the second engagement grooves 17*a* and 17*b* from each other), as shown in FIG. 7, side edges 7*aa* and 7*ba* (of which the former is not illustrated) of the first flaps 7*a* and 7*b* that have been overlapping the engagement tabs 13 engage with the engagement claws 9 on the first side segment 2. This prevents the first flaps 7*a* and 7*b* from swinging farther, and thereby prevents the first engagement grooves 8*a* and 8*b* and the second engagement grooves 17*a* and 17*b* from disengaging from each other.

Moreover, the resilient force of the sheet resulting from the top segment 5 and the engagement segment 6 being folded relative to each other makes it difficult for the engagement tabs 13 on the first flaps 7*a* and 7*b* and the engagement portions 20 on the second flaps 11*a* and 11*b* to disengage from each other.

Figure 8:
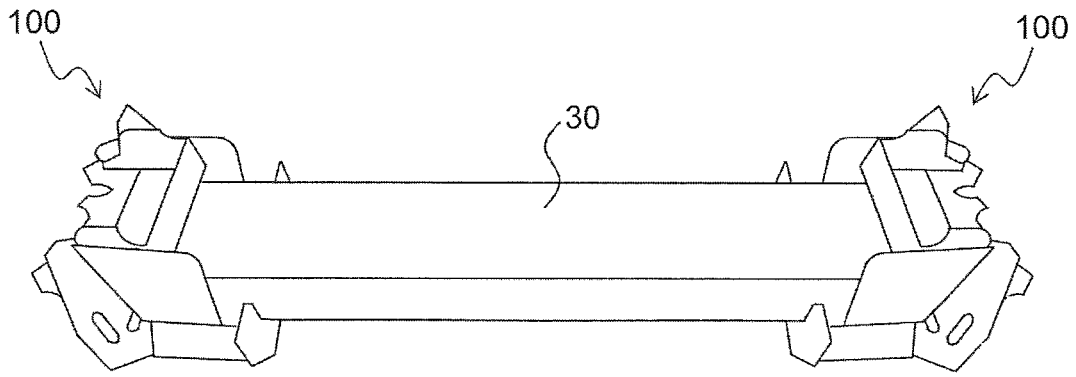
FIG. 8 is a perspective view showing a to-be-packed article 30 having the cushioning material 100 attached to it at each end.
Figure 9:
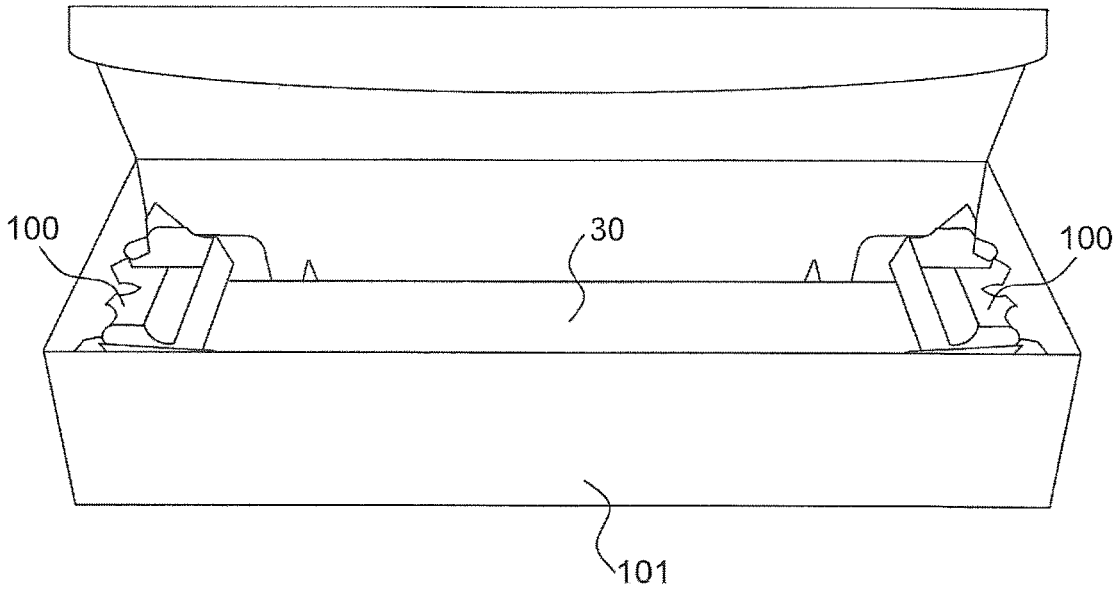
FIG. 9 is a perspective view showing the to-be-packed article 30 having the cushioning material 100 attached to it placed in a package box 101.

When an article to be packed is packed using the cushioning material 100 according to the present invention, as shown in FIG. 8, each end part of the article 30 is inserted into the space S (see FIG. 5) between the middle segment 4 and the top segment 5 of the cushioning material 100. Now, the article 30 is supported at each end on the cushioning material 100. Then, as shown in FIG. 9, the article 30 having the cushioning materials 100 attached to it is placed and enclosed in a package box 101. In this way, the article 30 is packed.

In FIGS. 8 and 9, the to-be-packed article 30 having the cushioning materials 100 attached to it is placed in the package box 101. Instead, the cushioning materials 100 can be placed in the package box 101 first, and the article 30 can be placed on them later. Specifically, first, two cushioning materials 100 with the engagement portions 20 on the second flaps 11*a* and 11*b* disengaged from the engagement tabs 13 are placed in the package box 101. In this state, the top segment 5 and the engagement segment 6 are freely swingable relative to the first side segment 2. Thus, the top segment 5 and the engagement segment 6 can be swung toward the first side segment 2 to secure a wide passage over the space S, and each end part of the article 30 can be inserted into the space S. Then, as shown in FIG. 5, the engagement portions 20 can be engaged with the engagement tabs 13 to complete the construction of the cushioning material 100.

Once the article 30 with the cushioning materials 100 attached to it is packed in the package box 101, the space between the middle segment 4, on which the article 30 is placed, and the bottom segment 1 absorbs (cushions) an external force from the direction of the bottom face of the package box 101 (i.e., from the direction indicated by arrow A in FIGS. 5 and 6). Moreover, owing to the third flaps 19*a* and 19*b* arranged contiguously with the bottom segment 1 being put under the middle segment 4, the resilient force of the third flaps 19*a* and 19*b* augments the cushioning effect.

In the cushioning material 100, opposite side edges of the first side segment 2 abut on the inner side faces of the package box 101 in its length direction, and top edges of the first side segment 2, the first flaps 7*a* and 7*b*, and the second flaps 11*a* and 11*b* abut on the inner side of the ceiling face of the package box 101. Thus, external forces from the directions of the side faces of the package box 101 in its length direction (e.g., from the directions indicated by arrows B and C in FIGS. 5 and 6) and from the direction of the ceiling face of the package box 101 (in FIGS. 5 and 6, the direction indicated by arrow D) can be absorbed.

Moreover, in the cushioning material 100, those edges (see FIG. 6) of the middle segment 4 and the first flaps 7*a* and 7*b* which protrude toward the first side segment 2 abut on an inner side face of the package box 101 in the direction perpendicular to its length direction. Thus, an external force from the direction of the side face of the cushioning material 100 in the direction perpendicular to its length direction (i.e., from the direction indicated by arrow E in FIGS. 5 and 6) can be absorbed.

Thus, using the cushioning material 100 according to the present invention, it is possible to securely absorb external forces from five directions with a single cushioning material 100. This helps reduce the number of cushioning materials 100 needed and the amount of cardboard sheet used to form the cushioning material 100, and to effectively prevent jolting and rattling of the packed article 30 during transport.

Moreover, by adjusting the number and size of the cut holes 10 formed in the first side segment 2, it is possible to adjust the cushioning performance of the cushioning material 100. The cut holes 10 do not necessarily have to be formed in the first side segment 2; they may instead be formed in the second side segment 3, the middle segment 4, the top segment 5, or elsewhere depending on the place where the cushioning performance needs to be adjusted.

Before being constructed, the cushioning material 100 is in the form of a single sheet as shown in FIG. 1. This permits a number of cushioning materials 100 to be stacked together. Out of the stacked cushioning materials 100, one after another can be taken and constructed to improve the efficiency of packing. Moreover, cushioning materials 100 before being constructed can be stored in a small space.

The present invention can be implemented in any manners other than specifically described above, and allows for many modifications and variations without departing from the spirit of the invention. For example, in the embodiment described above, the cut holes 10 are formed to lessen the cushioning performance. Instead, in a case where higher cushioning performance is required, the first flaps 7*a* and 7*b*, the third flaps 19*a* and 19*b*, or the like can be configured to have the sheet folded up into two stacked layers.

The cushioning material 100 according to the embodiment described above is merely a preferred example: the cut holes 10 and the third flaps 19*a* and 19*b* are not essential. That is, the configuration of the cushioning material 100 in its details can be modified as necessary to suit the shape of the article to be packed.

INDUSTRIAL APPLICABILITY

The present invention finds applications in cushioning materials constructed by folding a single sheet. The present invention provides a cushioning material that can be constructed easily by folding a single sheet and that can absorb external forces from five directions with no increase in the amount of sheet used.

The invention claimed is:

1. A cushioning material constructed from a single sheet material, comprising:

a rectangular bottom segment;

first and second side segments arranged at two opposite sides of the bottom segment, the first and second side segments being contiguous with the bottom segment across folding lines respectively;

a top segment arranged at a side of the first side segment opposite from the bottom segment, the top segment being contiguous with the first side segment across a folding line;

a middle segment arranged at a side of the second side segment opposite from the bottom segment, the middle segment being contiguous with the second side segment across a folding line;

an engagement segment arranged at a side of the top segment opposite from the first side segment, the engagement segment being contiguous with the top segment across a folding line;

a pair of first flaps arranged at two sides of the middle segment perpendicular to a side thereof at which the second side segment is contiguously arranged, the first flaps being contiguous with the middle segment across folding lines respectively;

a penetrated hole formed to extend from the middle segment beyond folding lines into parts of the first flaps respectively, the penetrated hole to be penetrated by the engagement segment;

a pair of second flaps arranged at two sides of the engagement segment perpendicular to a side thereof at which the top segment is contiguously arranged, the second flaps being contiguous with the engagement segment across folding lines respectively, the second flaps having engagement portions formed at respective tip ends thereof;

a pair of first engagement grooves formed at gaps between the first side segment and the top segment by extending the first side segment such that the first side segment embraces the top segment from opposite sides; and a pair of second engagement grooves formed by extending the penetrated hole at opposite ends thereof, wherein the bottom segment, the first side segment, the second side segment, and the top segment are folded into a rectangular column such that the second flaps and the engagement segment are inserted into the penetrated hole, the first flaps are folded away from the first side segment and the middle segment is folded toward the first side segment such that the second engagement grooves are fitted in the first engagement grooves, the engagement segment is folded to be substantially perpendicular to the top segment and the second flaps are folded to be substantially perpendicular to the engagement segment such that the engagement segment is engaged with the first flaps, with a result that the middle segment and the top segment are held substantially parallel to the bottom segment.

2. The cushioning material of claim 1, wherein at side edges of the first flaps respectively, engagement tabs are formed that protrude in a direction perpendicular to the second engagement grooves, the engagement tabs being folded inward to be engaged with the engagement portions.

3. The cushioning material of claim 2, wherein near open ends of the first engagement grooves respectively, engagement claws are formed that protrude inward from the first side segment, the engagement claws being engaged with side edges of the first flaps that overlap the engagement tabs when the engagement tabs are folded inward.

4. The cushioning material of claim 1, wherein a cut hole for adjusting cushioning performance is formed in at least one of the first side segment, the second side segment, and the top segment.

5. The cushioning material of claim 1, further comprising:

a pair of third flaps arranged at two sides of the bottom segment perpendicular to sides thereof at which the first and second side segments are contiguously arranged, the third flaps being contiguous with the bottom segment across folding lines respectively, the third flaps being put under the middle segment.

6. The cushioning material of claim 1, wherein a tip-end part of the middle segment relative to the penetrated hole is wider than an interval between the first engagement grooves such that, when the second engagement grooves are fitted in the first engagement grooves, the tip-end part of the middle segment relative to the penetrated hole folds into a V shape.

7. The cushioning material of claim 1, wherein let a width-direction dimension of the engagement segment be w1, let an opening width of the penetrated hole plus the second engagement grooves in their length direction be w2, and let a width-direction dimension of the engagement segment plus the second flaps be w3, then $w1<w2<w3$.

8. A package box in which an article is packed with the cushioning material of claim 1 arranged between the article and a package case.

* * * * *